United States Patent [19]

Burke et al.

[11] Patent Number: 4,625,883

[45] Date of Patent: Dec. 2, 1986

[54] FLOATING LID FOR PAINT CANS

[76] Inventors: Joseph J. Burke; George Spector, both of 233 Broadway, Rm. 3615, New York, N.Y. 10007

[21] Appl. No.: 693,527

[22] Filed: Jan. 22, 1985

[51] Int. Cl.[4] ..... B65D 25/10

[52] U.S. Cl. ..... 220/93

[58] Field of Search ..... 220/93, 216, 256, 354

[56] References Cited

U.S. PATENT DOCUMENTS

| | | | |
|---|---|---|---|
| 1,239,183 | 9/1917 | Hodgson | 220/354 X |
| 1,277,724 | 9/1918 | Hodgson | 220/354 X |
| 2,167,619 | 8/1939 | Bainton | 220/93 |
| 2,828,886 | 4/1958 | Thomas | 220/93 |
| 3,955,006 | 5/1976 | Sokolsky et al. | 220/256 X |
| 4,312,459 | 1/1982 | Leach | 220/93 X |
| 4,416,387 | 11/1983 | D'Antonio | 220/93 |

*Primary Examiner*—Steven M. Pollard

[57] ABSTRACT

A floating cover for a can of paint is provided and consists of disc having a flexible edge and a handle so that it can be placed into the can directly over the paint preventing the paint from coming in contact with the air. In another form the cover can be sandwiched between the lid and gutter of the can so that the flexible edges will increase the sealing capabilities of the lid to the gutter.

1 Claim, 6 Drawing Figures

FLOATING LID FOR PAINT CANS

BACKGROUND OF THE INVENTION

The instant invention relates generally to sealing devices and more specifically it relates to a floating cover for a can of paint.

Numerous sealing devices mave been provided in prior art that are adapted to cover liquid surfaces from the air above. For example, U.S. Pat. Nos. 2,556,195; 3,266,662 and 3,349,945 all are illustrative of such prior art. While these units may be suitable for the particular purpose to which they address, they would not be as suitable for the purpose of the present invention as heretofore described.

SUMMARY OF THE INVENTION

A principle object of the present invention is to provide a floating cover for a can of paint whereby the cover has a handle and flexible edges so that it can be placed into the can directly over the paint preventing the paint from coming in contact with the air.

Another object is to provide a floating cover for a can of paint with the handle having a level vial thereon so that the floating cover can be positioned level on top of the paint surface eliminating dead air space therebetween.

An additional object is to provide a floating cover for a can of paint sandwitched between the lid and gutter of the can so that the flexible edges will increase the sealing capabilities of the lid to the gutter of the can.

A further object is to provide a floating cover for a can of paint that is economical in cost to manufacture.

A still further object is to provide a floating cover for a can of paint that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
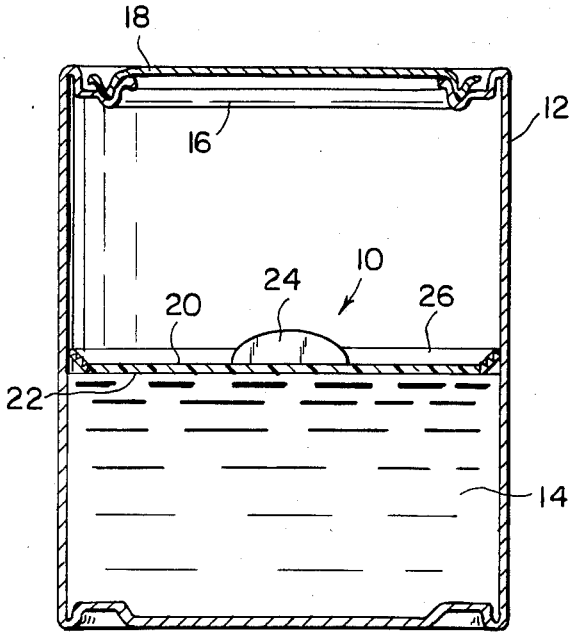
FIG. 1 is a cross sectional view through a paint can showing the invention in use therein.
Figure 2:
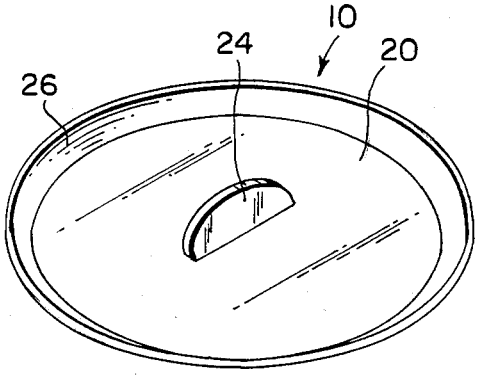
FIG. 2 is a perspective view of the invention showing the flexible edge turned up.

Turning now descriptively to the drawings, in which similar reference characters denote similar elements throughout the several views, FIGS. 1 and 2 illustrates a floating cover 10 for a can 12 of paint 14. The can 12 includes a gutter 16 and a lid 18. The cover 10 consists of a substantially flat circular disc 20 of a thin, flexible, bouyant impervious to air material. The disc 20 is of a diameter to fit closely inside the can 12 on surface 22 of the paint 14. An upwardly extending handle 24 is affixed to center of the disc 20 for removing the disc from the can 12 and inserting the disc 20 therein. The disc 20 further contains an annular turned up flexible edge 26 to allow for a greater seal within the can 12.

Figure 2A:
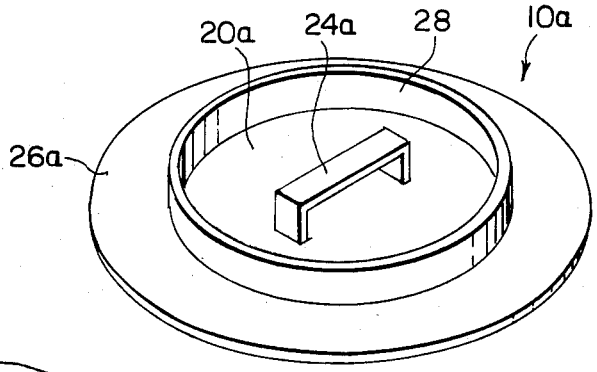
FIG. 2A is a perspective view of a first modification showing the flexible edge flat.

FIG. 2A shows a first modified cover **10*a* wherein the flexible edge 26*a* is flat while the disc 20*a* has an upstanding rim 28 around handle 24*a*. This allows for easy insertion within the can 12 and at the same time the cover 10*a* will maintain its proper shape on the surface 22 of the paint 14**.

Figure 3:
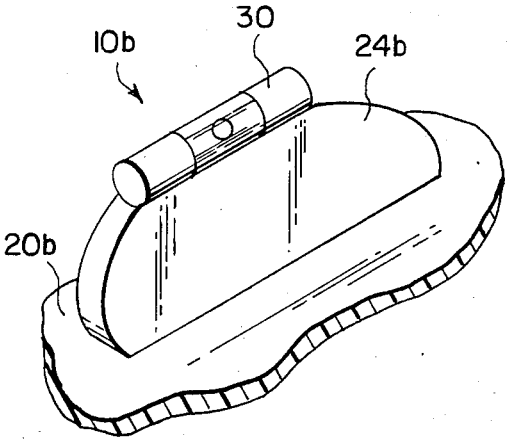
FIG. 3 is an enlarged perspective view with parts broken away of a second modification showing a handle with level vial attached thereto.

FIG. 3 shows a second modified cover **10*b* further containing a level vial 30 affixed to the handle 24*b* so that the disc 20*b* can be positioned level on the surface 22 of the paint 14** eliminating dead air space therebetween.

Figure 5:
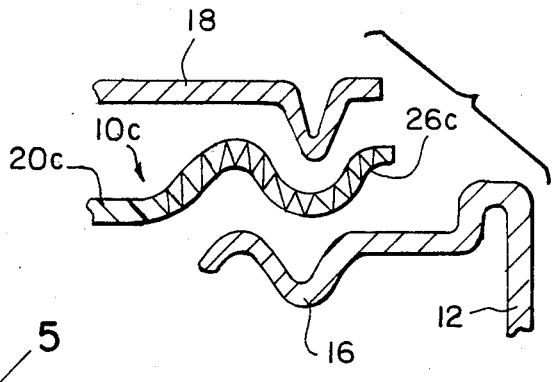
FIG. 5 is an enlarged exploded cross sectional view as indicated by numeral 5 in FIG. 4 showing the flexible edge used as a sealer between the lid and the gutter of the can.
Figure 4:
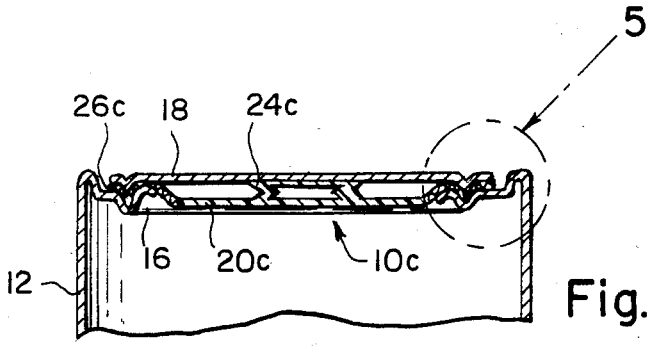
FIG. 4 is a cross sectional view through the upper portion of a paint can of a third modification shwoing the floating cover affixed between the lid and the gutter of the paint can.

In FIGS. 4 and 5 a third modified cover **10*c* is illustrated. The upwardly extending handle 24*c* is collapsible so that the flexible edge 26*c* of the disc 20*c* can be sandwiched between the lid 18 and the gutter 16 of the can 12 increasing the sealing capabilities of the lid 18 of the can 12 to the gutter 16. In this way the cover 10*c* could be sold with the can of paint so that when the lid 18 is removed the cover 10*c* will be available and ready to be used within the can 12 after some of the paint 14** is removed therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A floating cover for a can of paint, said can including a gutter and a lid, said cover comprising:

(a) a substantially flat circular disc of a thin, flexible, bouyant impervious to air material, said disc being of a diameter to fit closely inside said can on surface of said paint; and (b) an upwardly extending handle affixed to center of said disc for removing said disc from said can and inserting said disc therein, further comprising a level vial affixed to said handle so that said disc can be positioned level on said surface of said paint eliminating dead air space therebetween.

* * * * *